United States Patent [19]

Blanchet

[11] Patent Number: 4,506,591

[45] Date of Patent: Mar. 26, 1985

[54] OCEAN FLOOR DREDGE SYSTEM HAVING A PNEUMOHYDRAULIC MEANS SUITABLE FOR PROVIDING TRIPPING AND HEAVE COMPENSATION MODES

[75] Inventor: James Blanchet, Arlington, Wash.

[73] Assignee: Deepsea Ventures, Inc., Gloucester Point, Va.

[21] Appl. No.: 424,048

[22] Filed: Sep. 27, 1982

Related U.S. Application Data

[62] Division of Ser. No. 147,151, May 6, 1980, Pat. No. 4,382,361.

[51] Int. Cl.[3] ..... F01B 11/02; F15B 15/22

[52] U.S. Cl. ..... 92/85 B; 92/86; 92/110; 92/143; 91/396

[58] Field of Search ..... 91/396, 395, 394; 92/85 B, 110, 86, 10, 143

[56] References Cited

U.S. PATENT DOCUMENTS

| | | | |
|---|---|---|---|
| 1,799,366 | 4/1931 | Heinkel | 91/396 |
| 2,949,096 | 8/1960 | Ottestad et al. | 91/396 |
| 3,150,562 | 9/1964 | Allgeyer | 91/396 |
| 4,283,990 | 8/1981 | Leonard | 91/396 |

*Primary Examiner*—Paul E. Maslousky
*Attorney, Agent, or Firm*—Barry G. Magidoff

[57] ABSTRACT

There is provided a hoist as for an ocean floor dredging operation, which is capable of providing hydraulic heavy lifting capacity, for raising or lowering the dredging means between a surface ship and the ocean floor, and further can routinely provide the ship heave compensation when lifting capacity is not required, for example during dredging operation, or if the raising or lowering of pipe during pipe deployment and retrieval operations is discontinued for any other reasons, such as extremely high seas. The pneumohydraulic system comprises a piston slidably sealably movable within a cylinder and dividing the cylinder into upper and lower portions; a pneumohydraulic accumulator for providing hydraulic fluid to each of the cylinder portions and the necessary valve means to open and close the necessary connections for filling and evacuating one of the cylinder portions with hydraulic fluid without rendering hydraulically inoperative the second portion of the cylinder. A hollow spear extending above the piston head maintains an oil cap sufficient to provide damping capability with the damping means provided.

7 Claims, 5 Drawing Figures

OCEAN FLOOR DREDGE SYSTEM HAVING A PNEUMOHYDRAULIC MEANS SUITABLE FOR PROVIDING TRIPPING AND HEAVE COMPENSATION MODES

This is a division of application Ser. No. 147,151, filed May 6, 1980, now U.S. Pat. No. 4,382,361.

This invention is directed to means for supporting a relatively heavy, long, downwardly extending pipe string from a moving surface vessel, during dredging operations and during the paying out, or bringing in, of the pipe, so as to limit stress on the pipe and on the vessel. This invention is especially adapted for use in the support of the extremely lengthy and heavy dredge pipeline used in the recovery of ore material from the abyssal ocean floor.

With the recognition that terrestrial sources for raw materials, especially ores, are being swiftly depleted, effort has been made to obtain these valuable industrial raw materials from other sources, one being especially the abyssal depths of the oceans. Such raw materials, especially metal ores, are often found at depths of between 10,000 and 18,000 feet below the surface, requiring extremely deep water dredging means. The most valuable ores found to date are known as ocean floor nodule ores, or manganese nodules. These nodules are often found as relatively small particulate forms, including fist-sized rocks or smaller pebbles, or even as grains of sand. Sometimes solid shelves of these materials are found which would have to be broken up in order to be obtained.

A great deal of engineering effort has been undertaken to date to develop mechanical means to mine such ores and to bring the ores to the surface for further processing. One system now under development for carrying ocean floor ores to the surface of the ocean comprises a dredging vehicle, operating at or near the ocean floor, and a water-lift system, wherein the ore particles are carried upwardly to the surface in a stream of water defined by a length of pipe extending from the undersea dredge vehicle to a surface vessel. This pipe system is generally part of a so-called airlift means, wherein the water within the pipe is caused to flow upwardly by means of injections of air into the pipe at points below the surface.

A serious practical problem encountered in the design and operation of such a mining system arises as a result of the great weight of the dredge pipe string, which is of high strength, relatively thick, steel piping, extending for distances of, generally, from about two to three-and-one-half miles. The string is generally formed from a series of relatively short lengths of pipe, several hundred individual lengths, or sections, making up the total dredge pipe string. Necessary support for the dredge pipe string must be accomplished not only during the time when the entire pipe string is in place and dredging occurs by moving a dredge vehicle along the ocean floor or "seafloor", but also during so-called "tripping" when the pipe string is being let down to the ocean floor, i.e., by adding individual sections one at a time and gradually permitting the pipe string to thus descend towards the ocean floor, or when the pipe is being brought in, i.e., individual sections of pipe are serially removed from the pipe string and stored, while the dredge pipe length is gradually being shortened and the dredge vehicle brought to the surface of the ocean.

Support for the pipe string must be secure. An ocean mining pipe string can weigh as much as about 10,000 tons, and is extremely valuable. The support means must also be so designed as to limit the strain imposed upon the pipe, especially at the point of support on the pipe string.

The ocean vessel must be capable not only of bringing the dredging means to the desired dredge location and lowering a suitable dredge vehicle together with means to bring dredged material to the surface, but also must be capable of moving with the dredge vehicle as it moves along the ocean floor and to insure that the dredge vehicle remains in place on the ocean floor, regardless of the wave action on the surface. It is clear that wave action, especially during cases of extreme weather conditions, can cause severe vertical movement of the surface vessel, and which in turn can create conditions under which the connection between the dredge vehicle and the surface vessel is subjected to sharp and relatively large stress, which can cause damage to the connecting system and/or to the dredge vehicle, or can result in the dredge vehicle being alternately lifted off and dropped back down upon the ocean floor. Also, heaving of the ship will, in the absence of a motion compensating connection with the pipe, result in an axial vibrating force being applied to the pipe. If the frequency of such vibrating force, even though not precisely regularly cyclical, is close to a mode of natural vibration of the pipe string, a resonant, or near-resonant, excitation occurs; and damagingly large amplitudes of axial vibration and tensile stress can result. It is, therefore, desirable to be able to provide means to compensate for such vertical, or heaving, motion of the surface vessel caused by such wave action. Such heave compensation means have been provided for by others: for example, see U.S. Pat. No. 3,905,580.

It is an object of this invention to provide a single system capable of raising and lowering, i.e., tripping, the dredging equipment between the ocean floor and the surface, and also capable of providing heave compensation when not tripping pipe, e.g., during the dredging operation, while the dredge vehicle is moving along the ocean floor.

It is a further object of this invention to provide for means to maintain a desired fluid level in a pneumohydraulic system and means to provide a desirable motion damping effect.

In accordance with this invention, there are provided means which can be combined in a pneumohydraulic system, e.g., useful for the tripping of dredging equipment between a surface vessel and the ocean floor, and for providing heave compensation during dredging operations. The system is of great use on a floating surface vessel which supports and moves with a dredge vehicle during dredging of the ocean floor. First, there is provided a hydraulic cylinder, a hydraulic piston slidably movable within such cylinder and dividing the cylinder into an upper and lower portion. In one preferred embodiment there are filling means for filling and evacuating the upper portion of the cylinder with hydraulic fluid; pneumohydraulic accumulator means in fluid-pressure connection with the cylinder; hydraulic pressure reservoir means in fluid-pressure connection with the cylinder; valve means intermediate the accumulator and the cylinder and intermediate the hydraulic pressure source and the cylinder; and means to continuously maintain a predetermined maximum level of fluid above the cylinder, whereby each cylinder can be operated to provide the vertical force required during tripping of the dredge apparatus upwardly or downwardly, and to provide, during dredging operations, a soft, (i.e., small percentage change in force per unit displacement), coupling between the dredge pipe and the ship's structure, for the purpose of kinematically isolating the dredge pipe and attachments from the cyclical heave motion of the ship; thereby causing the dredge pipe to remain nearly vertically motionless. In another preferred embodiment, damping means are provided to protect the system against sudden, excessive motion.

The invention defined herein is exemplified by the embodiments described hereinbelow and depicted in the accompanying drawings.

The preferred embodiments are presented herein to provide a more clear understanding of the invention and its advantages, and to exemplify the invention without being exclusive thereof and are not intended to limit the scope of the invention.

Referring to the accompanying drawings.

DETAILED DESCRIPTION

Figure 1:
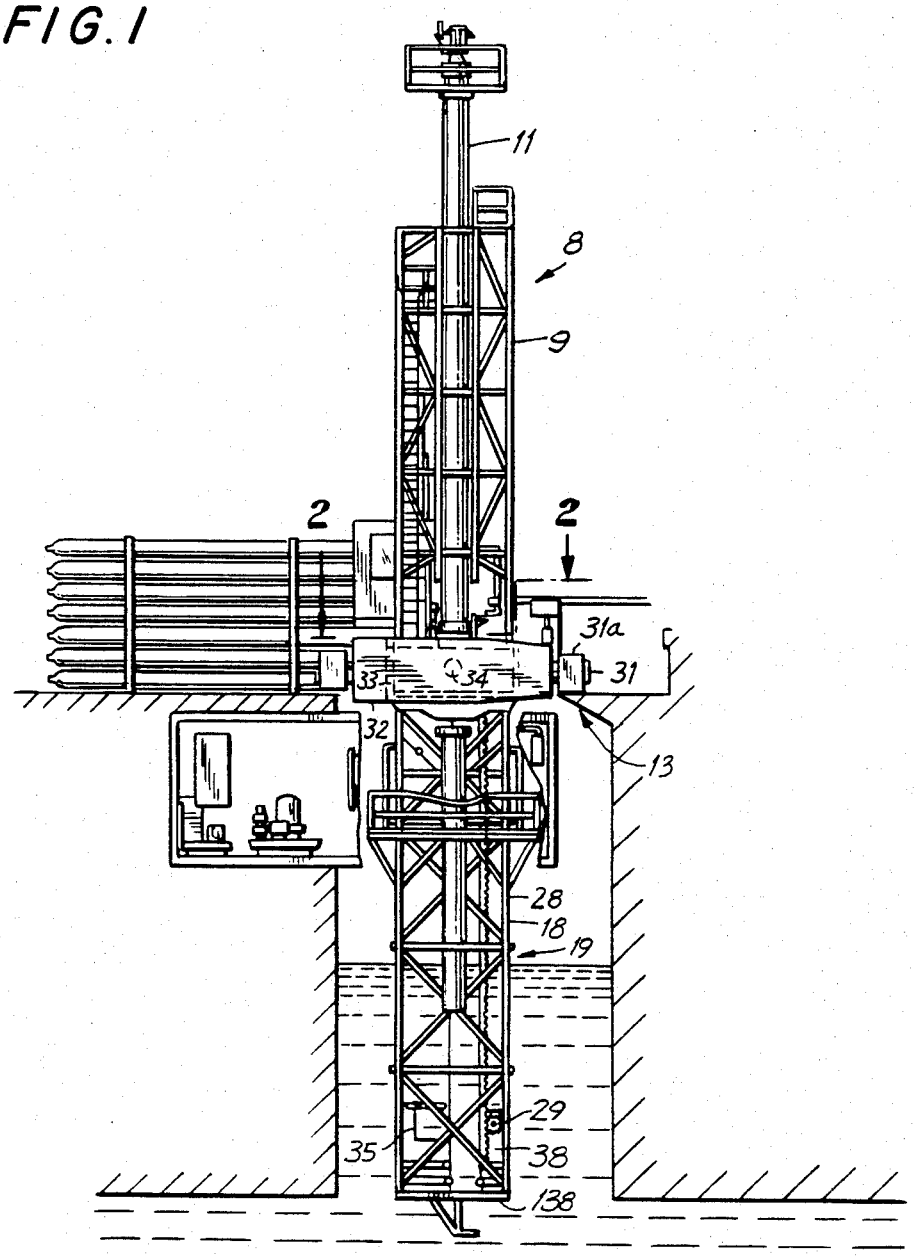
FIG. 1 is a side elevation of an ocean-going vessel fitted for ocean floor mining operations and including a dredge pipe string support system.
Figure 2:
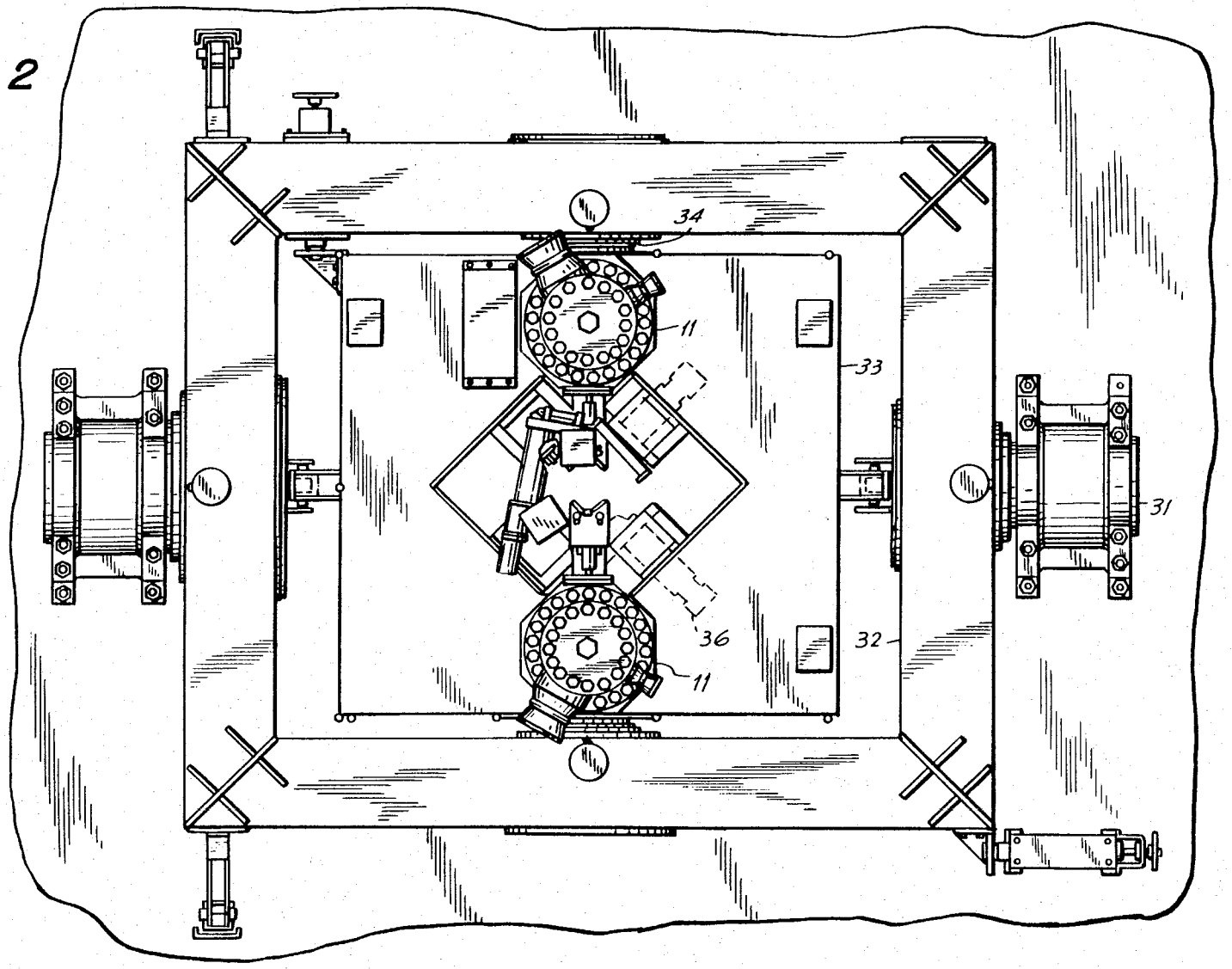
FIG. 2 is a cross-section view along lines 2—2 of FIG. 1.

FIGS. 1 and 2 show a side elevation and plan view of a dredge vehicle support system designed specifically for use on an ocean-going vessel for ocean floor mining operations. Relevant and unusual features of the ocean-going vessel, as shown in FIGS. 1 and 2 include a large central opening, or well, extending from the deck of the vessel through the bottom of the hull of the vessel. Extending above and below the deck opening are a superstructure and substructure, which extends through the well, and which are generally referred to as the upper and lower derricks 8 and 19, respectively. The derricks 8, 19 and associated pipe handling systems are mounted upon a gimbaled platform 33 which is pivotable relative to the vessel about two horizontal, transverse (substantially perpendicular) axes. The dredge pipe system, is supported directly from the inner gimbaled platform 33, and is thus maintained in a substantially vertical position, despite rolling and pitching motions of the dredging vessel.

The structure of the upper derrick 8 is formed about a pair of main hydraulic hoist cylinders 11 also supported on the inner gimbaled platform 33, and in this embodiment extending upwardly therefrom. The main hoist piston rods 12 extend downwardly through the lower derrick frame 18 from, and slidably connected inside of, the main hoist cylinders 11. Suspended from the two main hoist piston rods 12 is a hoist carriage 35, which moves together with the piston rods 12, vertically towards and away from the gimbaled platform 33, and guided within the lower derrick structure 19. The two hoist cylinders are preferably hydraulically interconnected, to maintain the movable hoist carriage 35 in a level position relative to the inner gimbaled platform 33. In addition, mechanical linking means can be provided to maintain the hoist carriage 35 in the desired level position.

Supported from the inner gimbaled platform 33, or from the moving carriage 35, are pipe string support means, each capable of supporting the dredge pipeline. In this embodiment, the dredge, on the ocean floor, is connected to a lift pipeline, such as an airlift pipe, which carries a suspension of ore particles in water from the ocean floor to the surface vessel. When preparing for dredging, the dredge vehicle is lowered from the surface vessel by serially connecting together the pipestring with the dredge vehicle being supported from the end of the pipestring. The pipestring is joined during the lowering operation, a single length of pipe being connected and then lowered, followed by the connection of a further length of pipe and the gradual lowering of the dredge vessel and the dredge pipeline to the ocean floor. During this tripping operation, the moving carriage 35 supports the upper end of a pipe length, to which is attached a new pipe length. As soon as the joint is completed between the two lengths of pipe, the moving carriage 35 moves downwardly until the upper end of the new pipe length is in contact with the pipe holding means on the gimbaled platform 33. The holding means on the carriage 35 then releases and the carriage is moved upwardly into position at the upper end of the new pipe length, preparatory for the attaching of a further new pipe length and the repetition of the cycle. For a more complete description of this operation, see copending U.S. application Ser. No. 108,122, entitled "PIPE STRING LIFT SYSTEM".

Figure 3:
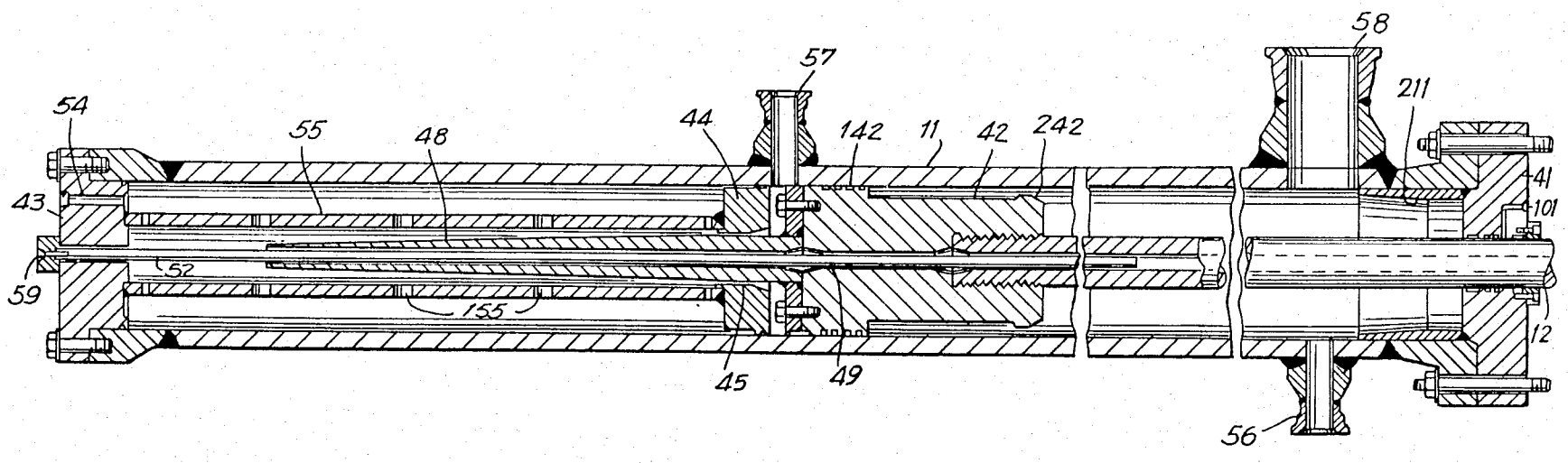
FIG. 3 is a cross-section view of one of the hydraulic cylinders shown in FIG. 1.

The present invention provides for the hydraulic cylinder means to be capable not only of raising or lowering the dredging system, but also of providing the desired heave compensation during the dredging operation on the open sea. In accordance with this invention, the core of this device rests in the use of a pneumohydraulic piston-cylinder arrangement and the necessary control and power system. The interior of each of the cylinders 11 is shown in cross-section in FIG. 3. Each cylinder 11 has a lower end cap 41 and upper end cap 43 bolted to each end to form a sealed compartment with the cylinder 11. A piston 42 is slidably movable longitudinally within the cylinder 11, the upper end of the piston 42, including rings 142, form substantially a moving seal with the inner surface of the cylinder 11. The interior of the cylinder 11 is divided by an interior partition 44 into a piston sweep zone, including the lower end cap 41 and an upper zone including upper end cap 43. A hollow tapered piston spear 48 extends upwardly from, and concentric with, the upper face of the piston 42, so that at the upper end of the piston's travel, the spear passes through a central aperture, defined by surfaces 45 in the interior partition 44, as shown in FIG. 3.

A central channel formed within the spear 48 continues through the piston 42 and at least part way through the piston rod 12. This channel is defined by interior surface 49. A hollow rod 52 extending from a central aperture through upper end cap 43 extends concentrically within the channel 49 through the piston spear 48, through the piston 42 and a portion of the way down through the channel 49 in the piston rod 12. The upper end of the hollow rod 52 is in fluid flow relationship with an hydraulic fluid vent 59. Extending from the inner partition 44 to the upper end cap 43 is a vented interior cylinder 55, formed, in this embodiment, concentric with the interior surface of the cylinder 11 and with the piston spear 48 and hollow rod 52. The side cylinder wall 55 has a plurality of ports arranged vertically.

During operation, the piston 42 divides the piston sweep zone into an upper portion and a lower portion. The upper sweep zone of each of the cylinders 11 is interconnected with the upper portion of the other cylinder via upper interconnect vent 57. The lower portion of the piston sweep zone of each of the cylinders 11 is interconnected with the lower zone of the other cylinder via lower interconnect vent 56. An air check vent 54 is placed through upper end cap 43, located radially between the inner cylinder 55 and the outer cylinder wall 11.

It should be noted that the length of the cylinder below the inner partition 44 is not completely shown in the drawing of FIG. 3. An approximate representation is set forth in FIG. 4 where, as is shown, the spear 48, during a major part of the stroke of the piston 42 is fully withdrawn from the aperture 45 through the inner partition 44, such that there is continuing fluid flow between the two portions of the cylinder divided by the partition 44. The hollow rod 52, however, is maintained within the piston channel 49 throughout the entire stroke of the piston 42.

Figure 4:
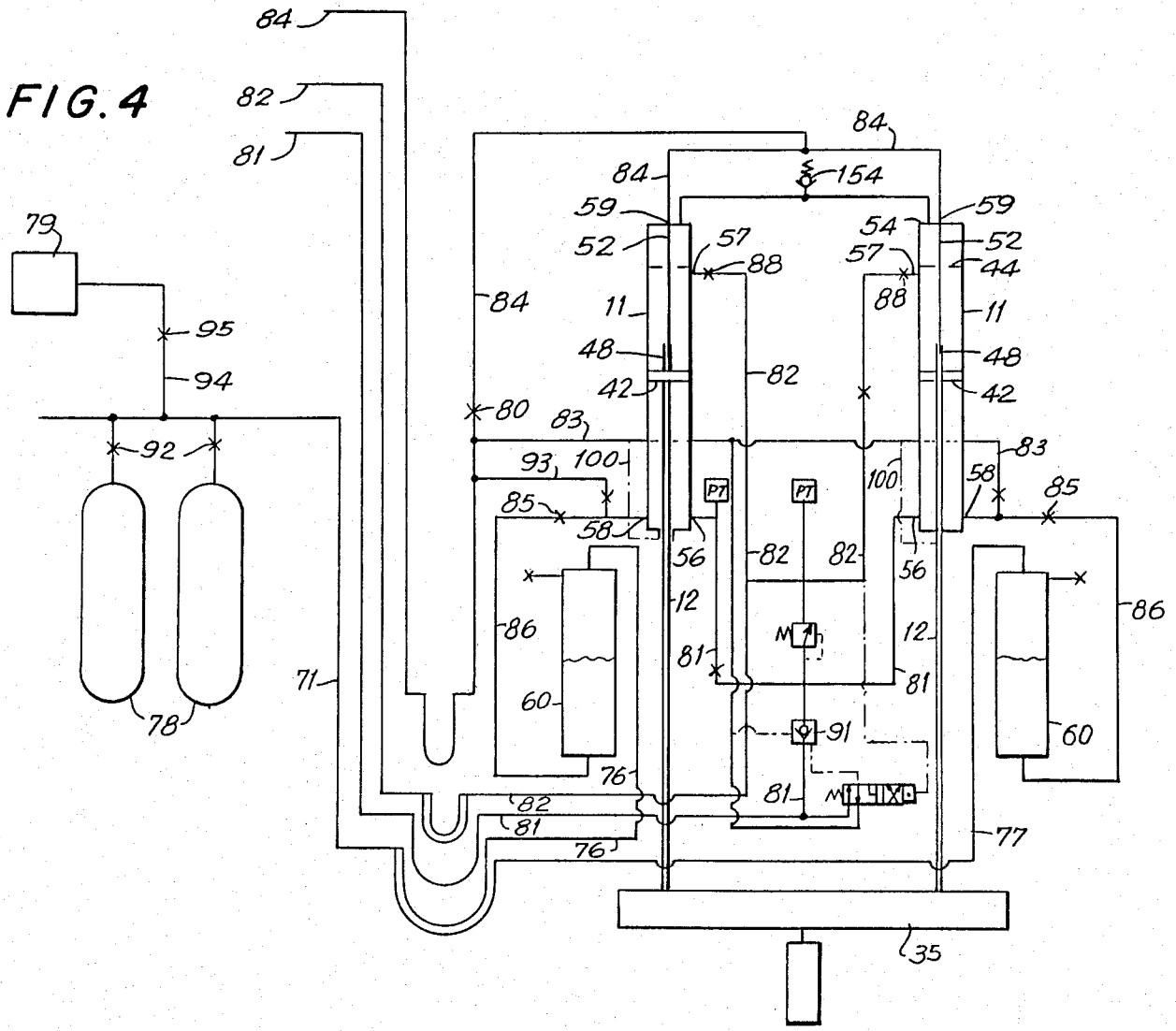
FIG. 4 is a schematic drawing of the hydraulic and pneumatic power system for the present invention.
Figure 5:
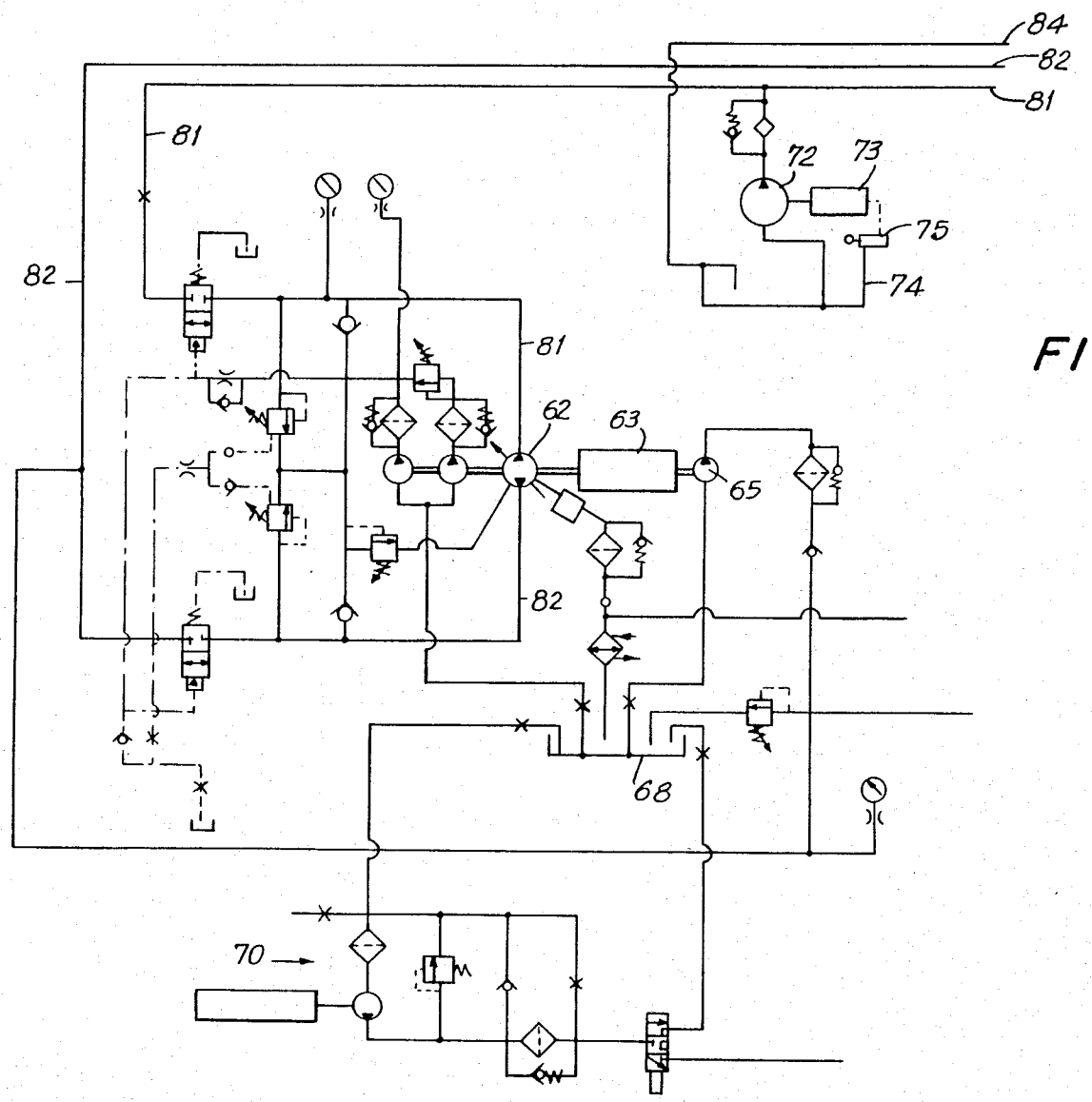
FIG. 5 is a schematic diagram of the control and activating system for the hydraulic and pneumatic power system of FIG. 4.

Referring to FIGS. 4 and 5, the two hydraulic hoist cylinders 11 are shown together with the pneumohydraulic power and control system in accordance with this invention. As stated, this system permits the use of the same cylinders to provide both the pneumohydraulic heave compensation mode and a tripping or lifting mode. The tripping or heavy lifting mode is a substantially wholly hydraulic mode of operation utilizing a relatively conventional hydraulic system. In this mode the interiors of cylinders 11 are substantially completely filled with hydraulic fluid, i.e., oil, on both sides of the piston 42, including the portion above the interior partition 44. A reversible variable hydraulic displacement pump 62 driven by an electric motor 63 is in fluid-flow connection between a so-called high pressure hydraulic line 81 and a low pressure hydraulic line 82. It should be noted that because of the reversible nature of the pump 62, the relative pressures in the hydraulic lines 81, 82 can also be reversed. The electric motor 63 also drives an hydraulic fluid auxiliary replenishment pump 65, capable of withdrawing hydraulic oil from a reservoir 68 and injecting the oil into the low pressure line 82, to which one side of the reversible pump 62 is connected. In accordance with conventional practice, the reservoir oil 68 can be filtered, using a conventional filtration system generally identified by the numeral 70.

The so-called high pressure hydraulic fluid line 81 is connected, through the lower interconnect vents 56, to the lowest portion of each cylinder 11. Between the pump 62 and the vents 56, in the line 81, is a lower lift valve 91. The so-called low pressure line 82 is connected, through the upper interconnect vents 57 to the upper portion of each cylinder 11, at a point immediately below the interior partitions 44. Upper lift valves 88 are present in the line 82 immediately adjacent each of the upper interconnect vents 57.

The lower portion of each of the cylinders 11 is also connected through the accumulator vent 58 to an accumulator line 86 and then to the bottom of an accumulator vessel 60. An accumulator valve 85 is interconnected in each accumulator line 86 between the cylinder 11 and the accumulator 60.

Each of the hydraulic fluid drain vents 59 in each of the cylinders 11, is connected to a hydraulic fluid drain line 84, which includes a drain valve 80. The drain line 84 is connected (as shown in FIG. 5) to an hydraulic fluid make-up reservoir 74, into which it drains. An hydraulic make-up pump 72 can take fluid from the reservoir 74 and inject it into the high pressure fluid line 81. The make-up pump 72 is driven by an electric motor 73, which is in turn activated by a float switch 75 connected within the reservoir 74, and sensitive to a change in the fluid level within the reservoir 74. The drain line 84 is also connected to a pair of accumulator drain lines 83, 93 connected to the two accumulators 60.

The accumulator vessels 60 are each partially (generally half) filled with the hydraulic oil; the upper half of each accumulator chamber 60 is filled with pressurized gas, such as air, and is connected through high pressure air lines 77, 76, 71 to a bank of compressed air storage bottles 78, through pressure valves 92. The bottles 78 are also connected to an air compressor 79, through compression line 94 and compressor valve 95.

The air vents 54 at the top of each of the cylinders 11 are both interconnected to an air vent check valve 154.

As explained above, both of the main hoist cylinders 11 operate simultaneously to raise and lower the moving carriage 35, which in turn supports the dredge pipeline, indicated by the initial A in FIG. 4. During the tripping, or heavy lift, mode the entire interior of both cylinders 11 is filled with the hydraulic fluid. Hydraulic fluid, or oil, is actively passed from the main pump 62, through line 81 to the lower portion of each of the cylinders 11, passing through the lower lift valve 91. The movement of the pressurized oil into the lower portion of the cylinder 11, in conventional fashion, causes movement of the pistons 42 upwardly, thereby forcing some of the oil in the upper portion of each cylinder 11 outwardly through the upper interconnect vents 57, through low pressure line 82 and then back to the second port of the main lift pump 62. When the dredge line is being lowered, together with the dredge vehicle, to the ocean floor, the upward movement of the carriage 35 is in a condition free of the pipeline A, thus only a minimum pressure is required. It is on the downward movement of the carriage 35, when the dredge line is being lowered by the length of a single piece of pipe, that the carriage 35 is supporting the entire dredge line, and the downward movement, of course, must be in a sufficiently slow manner so as to be safe and to prevent any damage to the equipment when the movement is halted at the lower end of the cycle. It is at this time, that the oil is very gradually removed from the lower portion of each cylinder 11, by reversing pump 62 thereby permitting the pistons 42 to move slowly downwardly as the volume of oil in the lower chamber is thus slowly reduced. When the dredge and pipeline are being brought back to the surface vessel, the carriage 35 must carry the entire remaining weight of the dredge line upwardly through its travel along the lower derrick structure 19. At this point, the pump 62 acts to slowly feed additional hydraulic oil into the lower portion, as explained above.

During the heave compensation mode of operation, e.g., when the dredge is operating on the ocean floor and the surface vessel is moving forwardly along the surface of the ocean, the upper portion of each cylinder 11, i.e., above the pistons 42, should be almost empty of oil, the upper portions being exposed to substantially atmospheric pressure, through the exhaust valve 154 and air vents 54. The upper portion of the cylinders 11 can contain an amount of hydraulic oil capable of filling the volume between the top of the piston head 42 and the end of the piston spear 48 nearest the upper end cap 43.

To remove the hydraulic fluid from above the piston 42, each piston 42 is moved to the upper end of its travel in the cylinder 11, thus forcing out most of the oil from above the piston 42 through lift valve 88, low pressure line 82 and back to the main pump 62. After the pistons 42 have reached the top of their travel within the cylinder 11, the main pump 62 is reversed, the oil is then slowly pumped out from beneath the piston head 42 by the main pump 62 until the piston 42 is in the desired middle position in the cylinder 11. No oil is permitted to enter the cylinder above the piston 42, as it descends, because the valve 88 in the low pressure line 82 is closed, thus leaving only air in the upper portion, except for an oil cap extending to the height of the spear 48 above the piston 42. As can be seen from FIG. 5, when the upper cylinder valve 88 is closed the hydraulic oil removed by the pump 62 is directed to the oil reservoir 68. The accumulator valves 85 are opened, and the lower lift valve 91 in the high pressure hydraulic line 81 are closed, the drain valve 80 in the oil drain line 84 is opened and the air check valve 154 is placed into an openable condition, at only a slight pressure above atmospheric. The main lift pump 62 and the auxiliary replacement pump 65 are inactivated during the heave comp mode of operation.

The heave comp make-up pump 72 continues to be activated to replace hydraulic fluid into the system that leaks past piston 42 and is drained through the oil drain line 84. The drained oil comes from the upper portion of the cylinders 11, through vents 59, passing into the make-up reservoir 74. The float switch 75 senses an increase in the reservoir level, indicating an excessive amount of drainage from the cylinders 11, which in turn automatically activates the electric motor to operate the make-up pump 72, which works to pass the hydraulic fluid from the make-up reservoir 74, to the high pressure line 81 and thence back to the lower portion of the cylinders 11. The lower portion of each cylinder 11, i.e., beneath the piston 42, is connected through the accumulator lines 86, and open accumulator valves 85, to the lower portion of the accumulators 60. Air pressure valves 92 are open, such that the upper portion of each of the accumulators 60, through the air pressure lines 71, 76, 77, are connected to a bank of pressure bottles 78, the total volume of the pressure bottles being determined by the required stroke of the piston 42 during the heave compensation mode. Furthermore, the pressure within the bank of bottles 78 is determined such that the pressure within the accumulators 60 is sufficient to support the carriage 35 and the dredge pipe string A via the piston rods 12 and pistons 42 within the cylinders 11 at a constant vertical position, absent wave motion acting against the surface vessel.

As stated above it is necessary to flush out the hydraulic oil from the portion of the cylinders 11 above the pistons 42 when changing from the tripping mode to the heave compensation mode of operation. The oil is flushed out until only a mere "cap" of oil, extending between the piston head, at the upper end of its travel as shown in FIG. 3 and the top of the piston spear 48, remains in the upper portion of the cylinder 11. Any oil of an amount greater than that will overflow into the annular channel between the interior surface of the piston spear 48 and the hollow rod 52, and move downwardly along that annulus into the lower portion of the piston rod 12. Upon several cyclical motions of the piston 42 within the cylinder, that excess oil is forced upwardly and out through the central portion of the rod 52 from the lower portion of the piston rod 12, out through the fluid drain vent 59 and into drain line 84, and then to the make-up reservoir 74. Thus, upon rearranging the valving as stated above, the movement of piston 42 itself can remove the desired excess oil from the upper portion of the cylinders 11. By maintaining substantially atmospheric pressure within the upper portion of the cylinders 11 above the pistons 42, by the vent valve 154, the cylinders 11 and pistons 42, can thus move vertically relative to each other; the upward and downward movement of the surface vessel, and thus of the cylinders 11, created by ocean wave action, thus cannot cause the pistons 42 (and thus the dredge line A supported by the carriage 35) to move vertically as long as the amplitude of the wave motion is less than the length of travel of the main hoist pistons 42 within the main cylinders 11.

It is anticipated that during the rather lengthy time that the heave compensation mode is operating, a significant amount of hydraulic fluid will leak around the piston seals 142 and into the upper portion of the cylinders 11. The automatic drain means, provided by the piston spear 48, prevents an eventual filling up of the upper portion of the cylinder 11, and thus avoids any shut down period for draining of the heave compensation cylinders.

It has been found, for example, that to maintain a weight of a dredge line pipe of about 10,000 tons, a pair of cylinders can be used, each having an interior diameter of approximately 18 inches and a total length of about 48 feet, with a piston spear 48 having a total length of approximately 63 inches. The lowest 11 inches of the spear 48, immediately adjacent the piston 42, is substantially cylindrical, having a diameter slightly smaller than the aperture 45; the upper portion of the spear 48 is tapered having a substantially constant slope to the end thereof. The horizontal internal cross-section of interior cylinder 55 has an area about one-quarter that of the internal cross-section of a cylinder 11.

The operation of the two cylinders 11 are maintained as synchronous as possible by insuring that the central hollow rod 52 of each cylinder is of the same length, and that all other dimensions are maintained equal.

A compressor 79 is provided to permit the varying of the pressure in the bank of bottles 78.

The tapered spear 48, interior partition 44, and the interior cylinder 11, provide what can be referred to as a two-step damper effect, i.e., an internal dashpot, to arrest longitudinal motion of the piston 42 and thus dissipate the energy resulting from the heave motion of the suspended pipe string relative to the surface vessel. For example, in the event of a sharp, sudden wave motion, or even worse, the sudden loss of the pipe string A, causing the surface vessel and thus the cylinder 11 to move downwardly relative to the piston 42, the spear 48 is caused to move towards and ultimately through the aperture 45. The cap of hydraulic fluid normally covering the piston head 42 up to the upper end of the spear 48 is thus forced through the annular opening between the spear 48 and aperture surface 45 and into the space within the interior cylinder 55.

The fluid fills the interior cylinder 11, and is thus forced outwardly through the ports 155 in the interior cylinder wall 55. The tapering of the spear 48 creates a variable annular opening with the aperture 45, thus increasing the pressure drop of the oil forced through the annular opening as the piston moves upwardly; this also increases the resistance or damping effect.

As a final protection to prevent direct contact between the partition 44 and the top of the piston head 42, the lowest portion of the spear 48 is cylindrical, almost completely closing off the aperture 45, and thus maintains the fluid between the piston 42 and partition 44. The fluid thus serves as a buffer.

A more conventional dashpot, for absorbing a far lower amount of kinetic energy, is shown at the lower end of the cylinder 11. This is formed between the tapered lower side wall 242, of the piston head, and the tapered interior surface 211 of the cylinder 11.

The patentable embodiments of this invention which are claimed are:

1. A hydraulic system designed to provide damping, the system comprising:

an enclosed cylinder, and upper and lower end caps for the upper and lower ends of the cylinder, respectively;

a piston head slidably sealably movable within the cylinder;

a piston rod secured to one end of the piston and extending sealably through one end cap;

a tapered elongated piston spear extending upwardly from the upper end of the piston towards the upper end cap, the diameter of the spear decreasing in an upward direction;

an interior partition extending across the cylinder and located between the piston head and the upper end cap, the partition having a central aperture concentric with the spear and having a diameter slightly greater than the greatest diameter of the spear, such that an annular opening of gradually smaller area is provided as the piston head approaches the interior partition;

fluid flow means for providing hydraulic liquid to the lower portion of the cylinder, between the piston and the lower end cap; and liquid level means to provide and maintain hydraulic liquid within the upper portion of the cylinder to a predetermined height above the piston head.

2. The hydraulic system of claim 1, further comprising a hollow perforated cylinder within the enclosed cylinder extending axially from a position adjacent the interior partition to a position adjacent the second end cap, the interior surface of the hollow cylinder being so positioned as to surround the interior partition central aperture, whereby fluid passing through the aperture passes into the hollow cylinder.

3. The hydraulic system of claim 2, wherein the portion of the piston spear immediately adjacent the piston head is substantially cylindrical, having a diameter smaller than the central aperture.

4. The hydraulic system of claim 1 wherein the fluid flow means are in fluid flow connection with the interior of the cylinder at a level between the interior partition and the lower end cap.

5. The hydraulic system of claim 1 wherein the liquid level means comprises a flow conduit through the piston spear in fluid flow connection at one end with the cylinder at the predetermined height above the piston head, and vent means in fluid flow connection with a second end of the flow conduit.

6. A hydraulic system designed to provide damping, the system comprising:

an enclosed cylinder having an upper end and a lower end, and upper end and lower end caps, for the upper and lower ends of the cylinder, respectively;

a piston head slideably sealably moveable within the cylinder;

a piston rod secured to one end of the piston and extending slideably sealably through the lower end cap;

a tapered elongated piston spear extending outwardly from the upper end of the piston towards the upper end cap, the diameter of the spear decreasing in an upward direction;

an interior partition extending across the cylinder and located between the piston head and the upper end cap, the partition having a central aperture concentric with the piston spear and having a diameter slightly greater than the greatest diameter of the piston spear, such that an annular opening of a gradually smaller area is provided as the piston head approaches the interior partition;

fluid flow means for providing hydraulic liquid to the lower portion of the cylinder below the interior partition;

each of the piston spear, piston head and piston rod defining a piston conduit opening into the cylinder at the upper end of the piston spear, and extending through the piston head and part way downwardly along the piston rod;

a hollow drain conduit extending from the upper end cap into and in fluid flow connection with the piston conduit;

vent means through the upper end cap in sequential fluid flow connection with the hollow drain conduit and piston conduit;

whereby a liquid cap of predetermined height above the piston head can be maintained within the cylinder to provide the desired damping capability as the piston moves upwardly and the piston spear passes through the aperture in the interior partition.

7. The hydraulic system of claim 6 further comprising a hollow perforated cylinder within the enclosed cylinder and extending axially between the interior partition and the upper end cap, the hollow cylinder being substantially concentric with the aperture through the inner interior partition, whereby fluid passing through the aperture passes into the hollow cylinder such that the damping capability of the system is further improved.

* * * * *